US007850494B2

(12) United States Patent
Magno, Jr. et al.

(10) Patent No.: US 7,850,494 B2
(45) Date of Patent: Dec. 14, 2010

(54) BATTERY TERMINAL CONNECTOR

(75) Inventors: Joey D. Magno, Jr., Cordova, TN (US); Xueming Cai, Collierville, TN (US); Jerry Woodward, Collierville, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 101 days.

(21) Appl. No.: 12/243,018

(22) Filed: Oct. 1, 2008

(65) Prior Publication Data

US 2009/0124118 A1 May 14, 2009

Related U.S. Application Data

(60) Provisional application No. 61/002,377, filed on Nov. 8, 2007.

(51) Int. Cl.
*H01R 3/00* (2006.01)

(52) U.S. Cl. ..... 439/754

(58) Field of Classification Search ..... 439/500, 439/726, 773, 772, 756–758, 761, 762, 754
See application file for complete search history.

(56) References Cited

U.S. PATENT DOCUMENTS

| | | | | |
|---|---|---|---|---|
| 1,868,939 | A | 7/1932 | Conrad | |
| 1,943,190 | A | 1/1934 | Sands | |
| 2,011,537 | A | 8/1935 | Ellis et al. | |
| 2,185,419 | A | 1/1940 | Packard | |
| 2,257,013 | A | 9/1941 | Johnson | |
| 2,492,256 | A | 12/1949 | Bailiff | |
| 2,706,284 | A * | 4/1955 | Hoggatt et al. | 439/757 |
| 2,769,964 | A * | 11/1956 | Lartz | 439/757 |
| 3,005,181 | A | 10/1961 | Ament | |
| 4,385,796 | A | 5/1983 | Eriksson | |
| 4,555,159 | A | 11/1985 | Chartrain et al. | |
| 4,695,118 | A * | 9/1987 | Magdesyan et al. | 439/726 |
| 4,964,819 | A * | 10/1990 | Caraballo | 439/773 |
| 5,024,619 | A | 6/1991 | Caraballo | |
| 5,269,709 | A * | 12/1993 | Eriksson | 439/772 |
| 5,584,730 | A * | 12/1996 | Tabata | 439/762 |
| 5,588,883 | A * | 12/1996 | Hattori | 439/761 |
| 6,287,155 | B1 * | 9/2001 | Yakovich | 439/772 |

(Continued)

FOREIGN PATENT DOCUMENTS

| | | |
|---|---|---|
| EP | 1 180 819 | 7/2001 |

(Continued)

*Primary Examiner*—Alexander Gilman
(74) *Attorney, Agent, or Firm*—Hoffmann & Baron, LLP

(57) ABSTRACT

A cable connector having a one-piece body with a termination end for terminating an electrical cable and a clamping end for clamping to a terminal post is provided. The cable connector's clamping end may include a pair of spaced apart deformably movable clamping arms for supporting the terminal post therebetween. A lever attached to the movable arms may also be provided where the lever may be actuable between a first position urging the arms towards one another to clamp the clamping end to the terminal post and a second position urging the arms apart so as to unclamp the arms from the terminal post to permit removal of the connector body from the terminal post.

6 Claims, 9 Drawing Sheets

U.S. PATENT DOCUMENTS

| | | | | |
|---|---|---|---|---|
| 6,554,657 | B2 * | 4/2003 | Krause et al. | 439/773 |
| 6,623,315 | B1 | 9/2003 | Roderick | |
| 6,773,310 | B2 | 8/2004 | Davis | |
| 6,802,747 | B1 | 10/2004 | Orange | |
| 6,971,925 | B1 | 12/2005 | Orange | |
| 2006/0199442 | A1 * | 9/2006 | Freitag | 439/773 |

FOREIGN PATENT DOCUMENTS

| | | |
|---|---|---|
| FR | 2 227 648 | 11/1974 |
| WO | WO 01/17066 | 3/2001 |

* cited by examiner

BATTERY TERMINAL CONNECTOR

CROSS-REFERENCE TO RELATED APPLICATION

This application claims priority to U.S. Provisional Patent Application No. 61/002,377 on Nov. 8, 2007, herein incorporated by reference.

FIELD OF THE INVENTION

The present invention is directed generally to a connector for terminating an electrical cable to a terminal post such as a battery terminal. More particularly, the present invention provides a battery terminal clamp for permitting clamping and unclamping of a cable connector to a terminal post.

BACKGROUND OF THE INVENTION

Battery cables are typically attached to the terminal post of a battery using a clamp type battery connector. These connectors include a barrel portion for accommodating a stripped end of the battery cable and a clamping portion which is positioned about the upstanding terminal post. The clamping portion may be tightened around the terminal post to provide secure connection thereto. The clamping portion of most battery connectors includes a pair of arms defining a circular portion therebetween which may be positioned around the battery terminal post. The ends of the arms may be brought together with a fastening device such as a nut and bolt to tightly secure the arms about the battery post.

The art has also seen a number of quick connection clamp type cable connectors where clamping is facilitated by an actuator attached to the clamp. This enables the user to connect the cable to the battery terminal post without need of operating a fastener such as a nut and bolt. Many of these quick connect battery connectors employ a lever arm which is attractable to bring two halves of a clamp connector together about the upstanding battery post. However, certain disadvantages are inherent in these types of two-piece lever actuated connectors. First and foremost, the connector must include two connector components which must be attached to one another so that they are movable about the battery terminal post upon actuation of the lever. In addition, these lever type battery connectors provide for urging the connector components together around the battery post upon actuation of the lever. Release of the lever does not affect reverse movement of the component so as to facilitate removal of the battery connector from the post.

It is, therefore, desirable to provide a clamp type cable connector for attachment to a battery terminal post where the connector includes an actuation mechanism which clamp and unclamps the connector to the terminal post.

SUMMARY OF THE INVENTION

The present invention provides a cable connector including a body having a termination end for terminating an electrical cable and a clamping end for clamping to a terminal post. The clamping end of the body includes a pair of spaced apart deformably movable clamping arms for supporting the terminal post therebetween. A lever is attached to the movable arms of the body. The lever is actuatable between a first position urging the arms towards one another to clamp the clamping end to the terminal post and a second position urging the arms apart so as to unclamp the arms from the terminal post to permit removal of the connector body from the terminal post.

In the preferred embodiments of the present invention, the arms and the lever include cooperative first cam members for engagement upon movement of the lever to the first position urging the arms towards one another and second cooperative cam members for engagement upon movement of the lever to the second position urging the arms apart permitting removal of the connector from the terminal post.

DETAILED DESCRIPTION OF THE PREFERRED EMBODIMENT

The present invention provides for a tool-less battery connector for quickly connecting and disconnecting to a terminal post, such as a battery terminal post.

Figure 1:
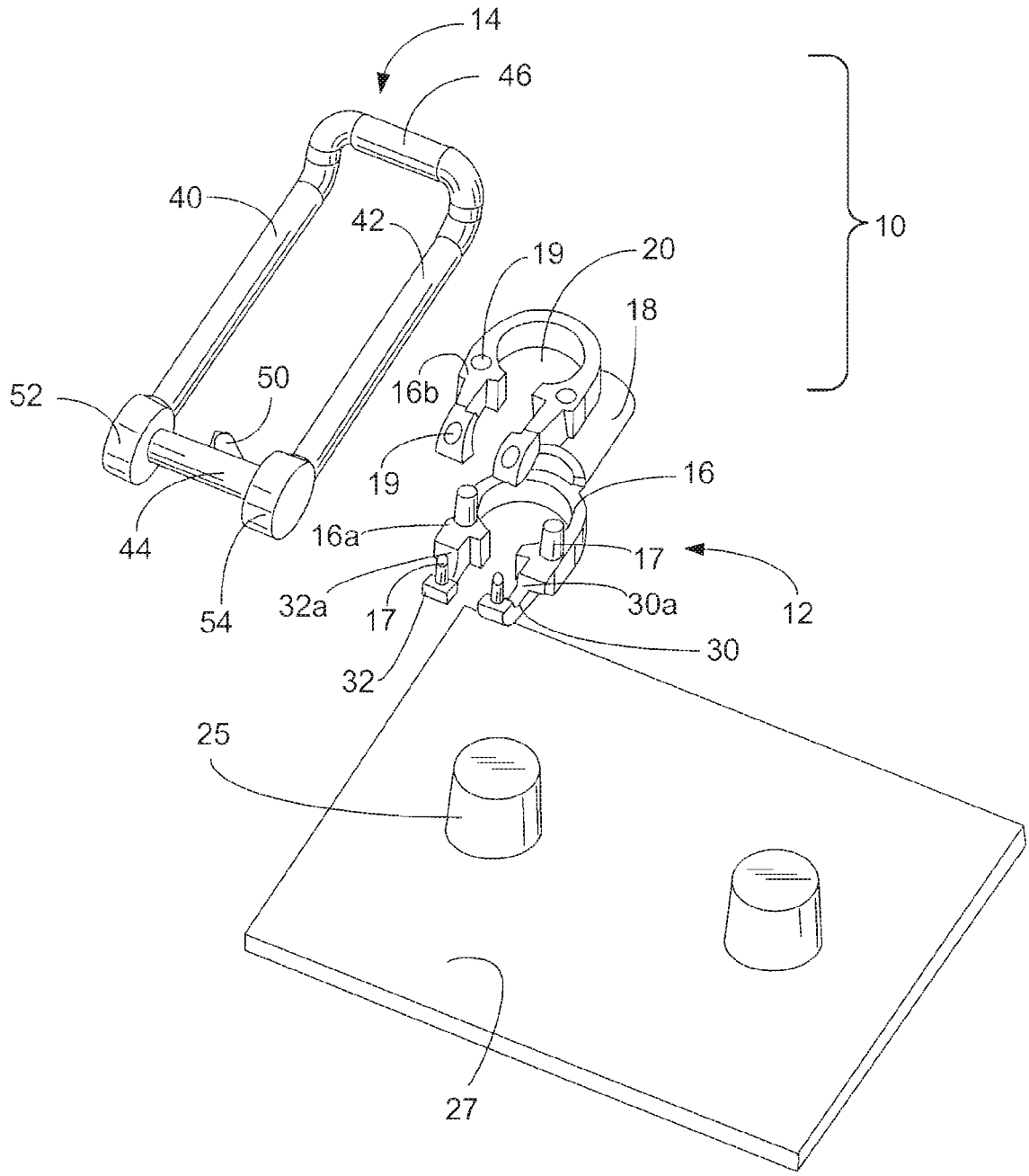
FIG. 1 is an exploded perspective view of the connector of the present invention shown over the terminal post of a battery.

Referring to FIG. 1, the battery terminal connector 10 of the present invention is shown. The connector 10 includes a connector body 12 and a lever 14 which is connected to body 12 for pivotal movement therewith. The connector body 12 includes a clamping end 16 and an opposed termination end 18 extending therefrom.

Clamping end 16 may be formed of two clamping halves 16*a*, 16*b* which are brought together to support the lever 14 therebetween, as will be described in further detail hereinbelow. The lower clamping half 16*a* includes a plurality of upstanding protrusions 17 which are insertable into aligned openings 19 formed through the upper portion 16*b* so as to couple the two clamping halves 16*a*, 16*b*, thereby forming clamping end 16. The protrusions 17 extend through openings 19 and the extending portions 17*a* (FIG. 7) may be crimped, or swaged to secure the two clamping halves together.

Clamping end 16 includes an aperture 20 extending therethrough which is designed for accommodation over the upstanding post 25 of a battery 27. The aperture 20 forms nearly a full circle to encompass the post 25. Clamping end 16 further includes a pair of spaced apart outwardly extending deformable clamping arms 30, 32 which provides for clamping engagement about post 25.

The termination end 18 of body 12 may be formed into an elongate cylindrical barrel. The barrel shape allows accommodation of the stripped end of an electrical cable, such as a battery cable (not shown). The barrel of the termination end 18 may be crimped about the cable in conventional fashion. In the present illustrative embodiment, the barrel shaped termination end 18 extends from lower clamping half 16*b*.

Lever 14 is an elongate member having a pair of spaced apart elongate arms 40, 42. The arms are joined at one end by a transverse pivot pin 44 and at the other end by an offset transverse handle 46. Generally, the offset of handle 46 is sized to partially extend around a cable connected to termination end 18 when in the clamped condition. The pivot pin 44 has formed thereon a protruding wedge-shaped central member 50 which will be described in further detail hereinbelow.

The pivot pin 44 is attached to arms 40, 42 at generally cylindrical flanges 52, 54. As an option, the arms 40, 42 may be removable from flanges 52, 54. In assembly, pivot pin 44 is seated for rotational movement within aligned apertures 30*a*, 32*a* of arms 30, 32 formed between upper and lower clamping halves 16*a*, 16*b*.

As the connector 10 of the present invention is designed to terminate an electrical cable, such as a battery cable, to a terminal post of a battery, the connector 10, including body 12 and lever 14, is typically formed of an electrically conductive metal, such as copper, aluminum or steel.

Figure 2:
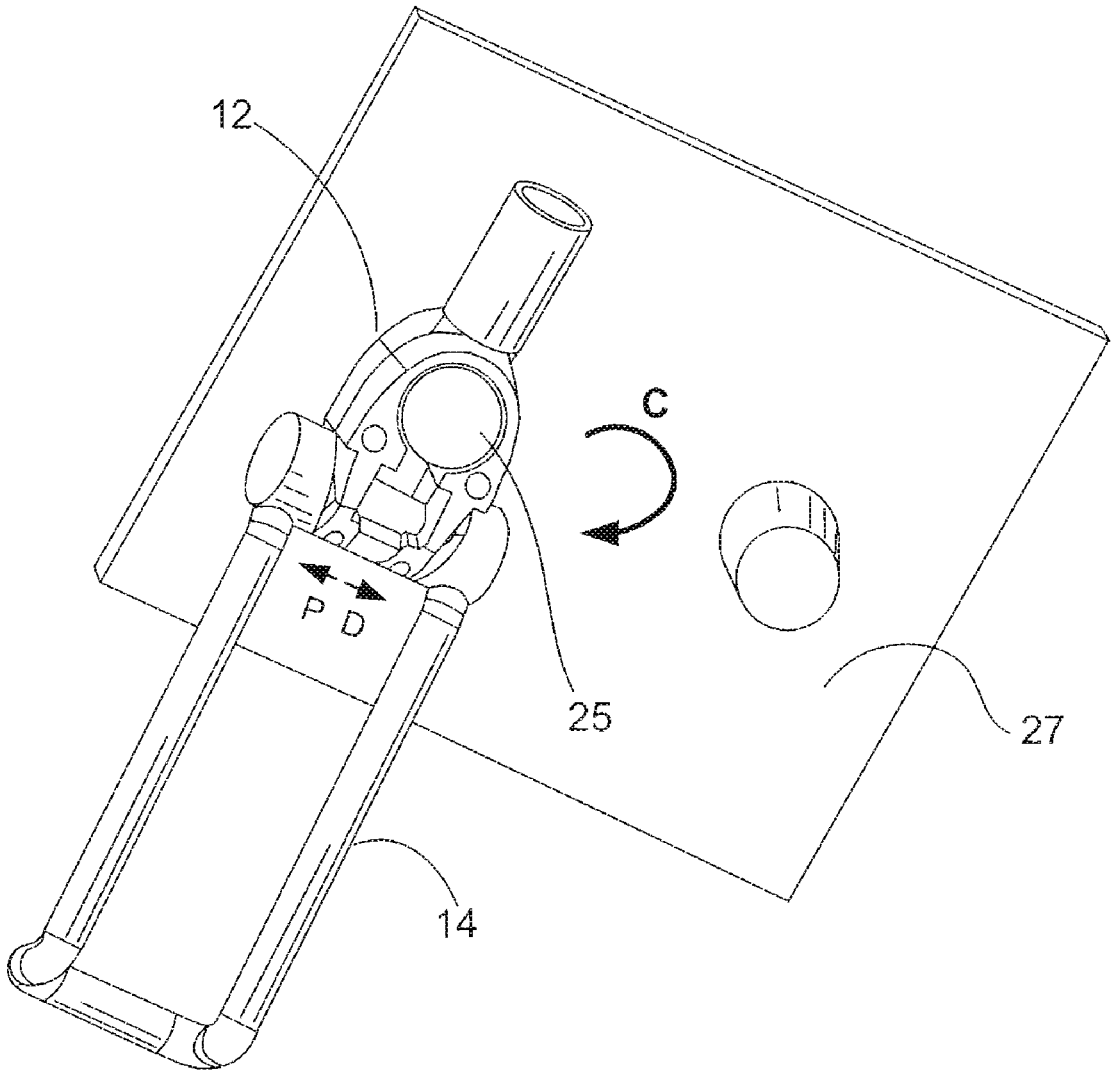
FIGS. 2 and 3 are perspective showings of the connector of the present invention connected to the post of the battery in the unclamped and clamped conditions, respectively.
Figure 3:
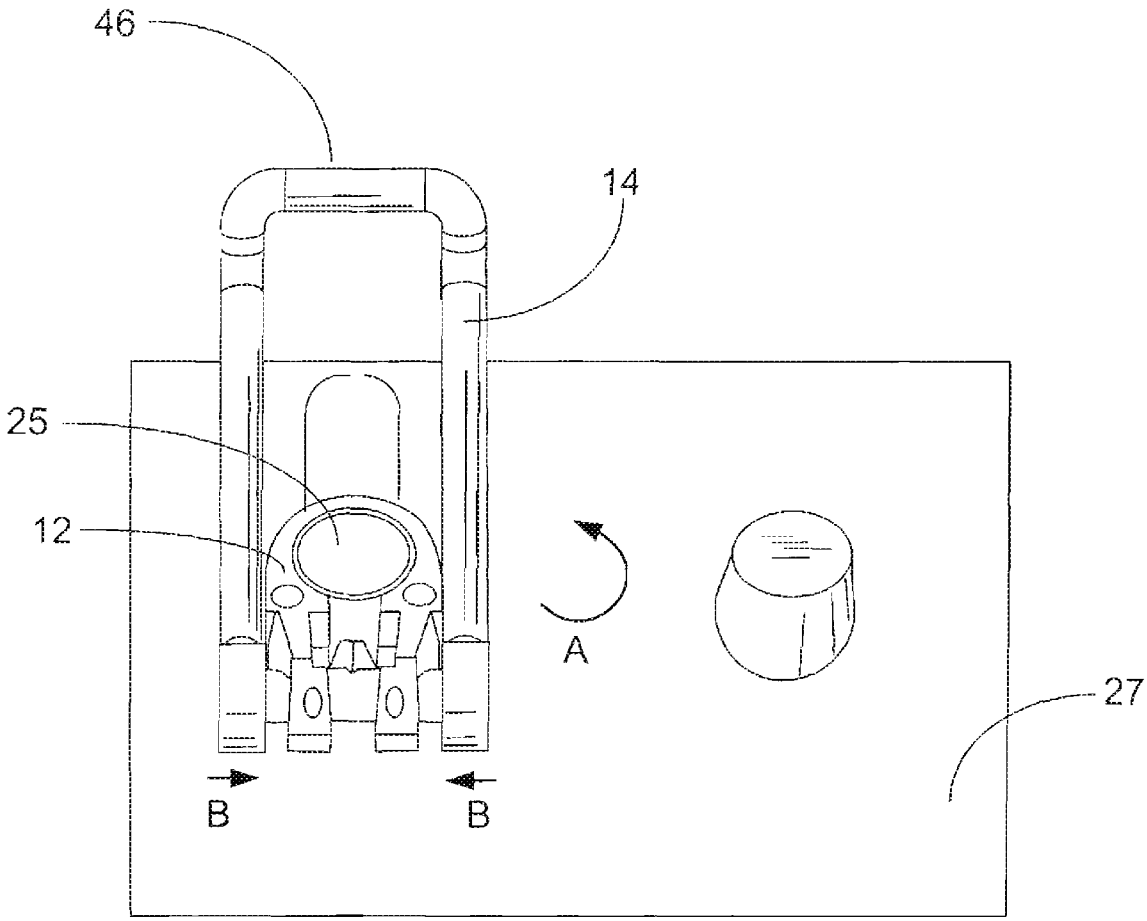

Referring to FIGS. 2 and 3, the assembled connector 10 of the present invention is shown attached to battery 27. As shown in FIG. 2, the lever 14 is shown in an unclamped condition, so that the connector body 12 may be attached and removed from the upstanding post 25 of battery 27. In FIG. 3, the lever 14 is shown rotated to its clamped condition, clamping the connector body 12 to the post 25.

Figure 4:
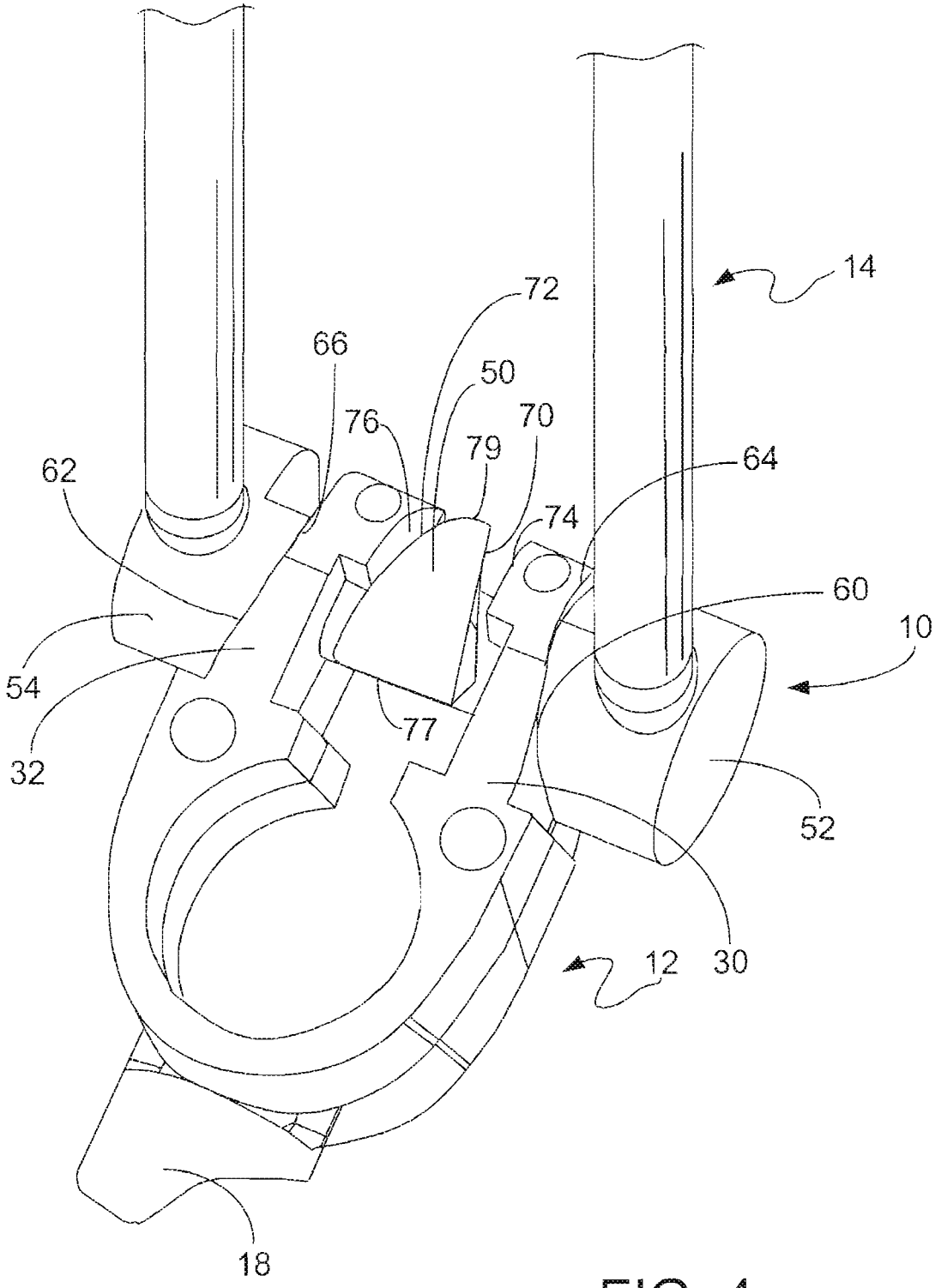
FIGS. 4, 5 and 6 show the connector of the present invention in the neutral clamped and unclamped conditions, respectively.

Referring now to FIG. 4, the connector 10 of the present invention is shown in its neutral position. In this position, the spacing between the arms 30 and 32 is such that the connector body may be easily placed over post 25.

The flanges 52, 54 of lever 14 include inwardly directed cam surfaces 60, 62. The cam surfaces 60 and 62 are helically tapering members. The cam surfaces 60, 62 are designed for cooperative earn engagement with tapered cam surfaces 64, 66 formed on opposed outer surfaces of arms 30, 32. The cam surfaces 64, 66 include tapered surfaces which cooperate with the tapering surfaces of cam surfaces 60 and 62 of flanges 52, 54.

As shown in FIG. 4, wedge-shaped central member 50 protruding from pivot pin 44 is generally a triangular member having a wide base 77 and a narrow tapered opposed end 79. The central member 50 defines opposed outwardly directed cam surfaces 70, 72 which are generally tapered. The cam surfaces 70, 72 are designed for cooperative cam engagement with cam surfaces 74, 76 on arms 30, 32. Cam surfaces 74, 76 are inwardly directed and include tapering surfaces.

As will be described in further detail hereinbelow, the engagement between cam surfaces 60, 62 of flanges 52, 54 with the outwardly directed cam surfaces 64, 66 of arms 30, 32 provides for the deformable inward movement of clamping arms 30, 32 to clamp body 12 about post 25 upon rotation of lever 14 in a first or closed position. Moreover, the engagement between cam surfaces 70, 72 of central member 70 with inwardly directed cam surfaces 74, 76 of arms 30, 32 provides for the opening of arms 30, 32 upon reverse rotational movement of lever 14.

Figure 5:
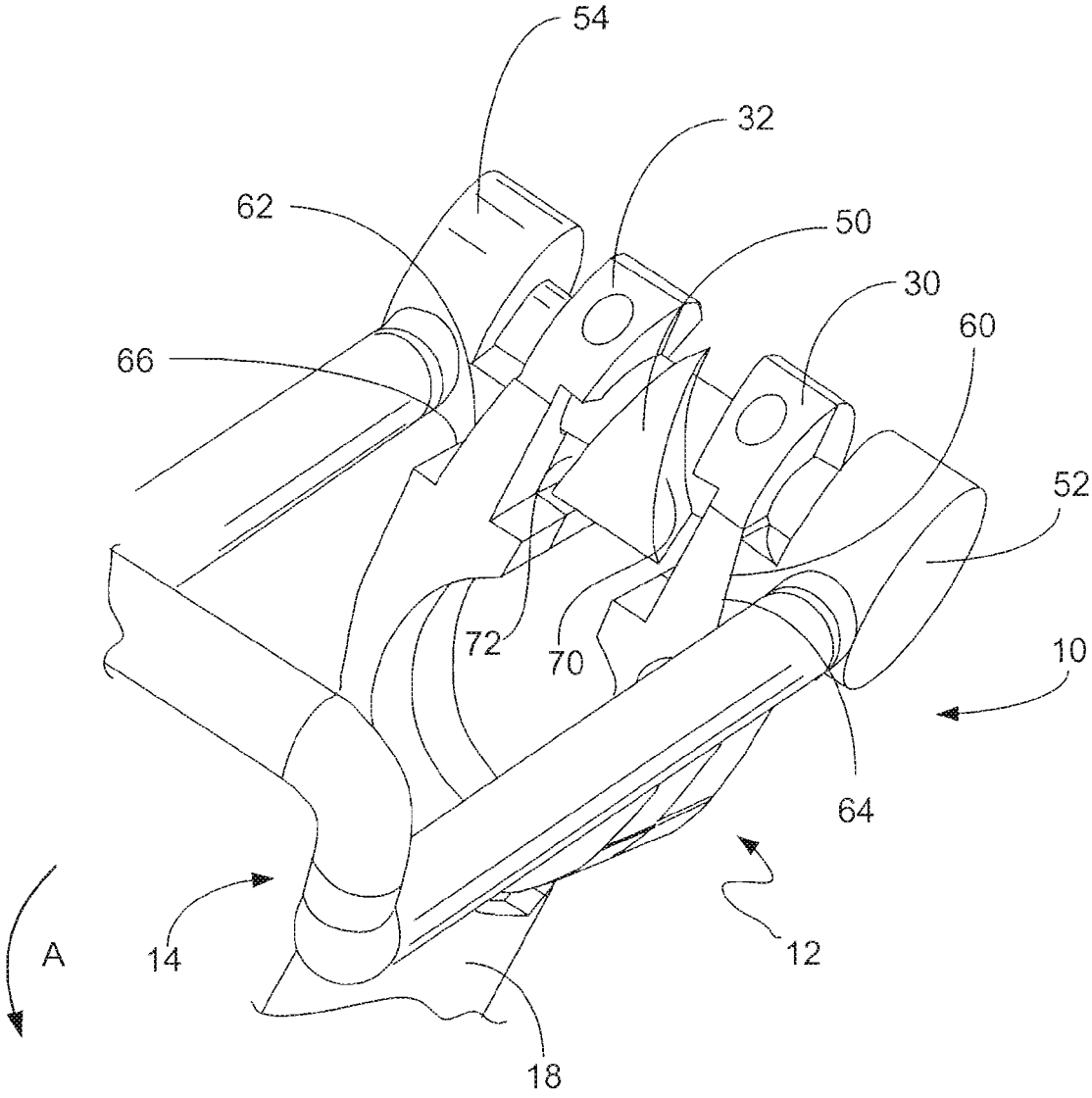

Referring now to FIGS. 3 and 5, the lever 14 is shown moving to the closed position clamping the connector body 12 to the terminal post 25 of battery 27. As the lever 14 is rotated in the direction of arrow A so that the handle 46 moves downwardly towards the termination end 18 of connector 10, rotation of pivot pin 44 causes cams 60, 62 of flanges 52, 54 to engage cams 64, 66 of clamping arms 30, 32. This causes the deformable clamping arms 30, 32 to be moved inwardly as shown by the arrows B in FIG. 3 to clamp the connector body 12 about terminal post 25.

The progressive engagement of the cam surfaces 60, 62 and 64, 66 causes the arm 30, 32 to provide secure clamping engagement about post 25. The lever 14 may be brought downwardly as shown in FIG. 3, so that it is generally parallel with the connector body 12 where the offset handle 46 provides clearance for the electrical cable (not shown) extending from termination end 18.

Figure 7:
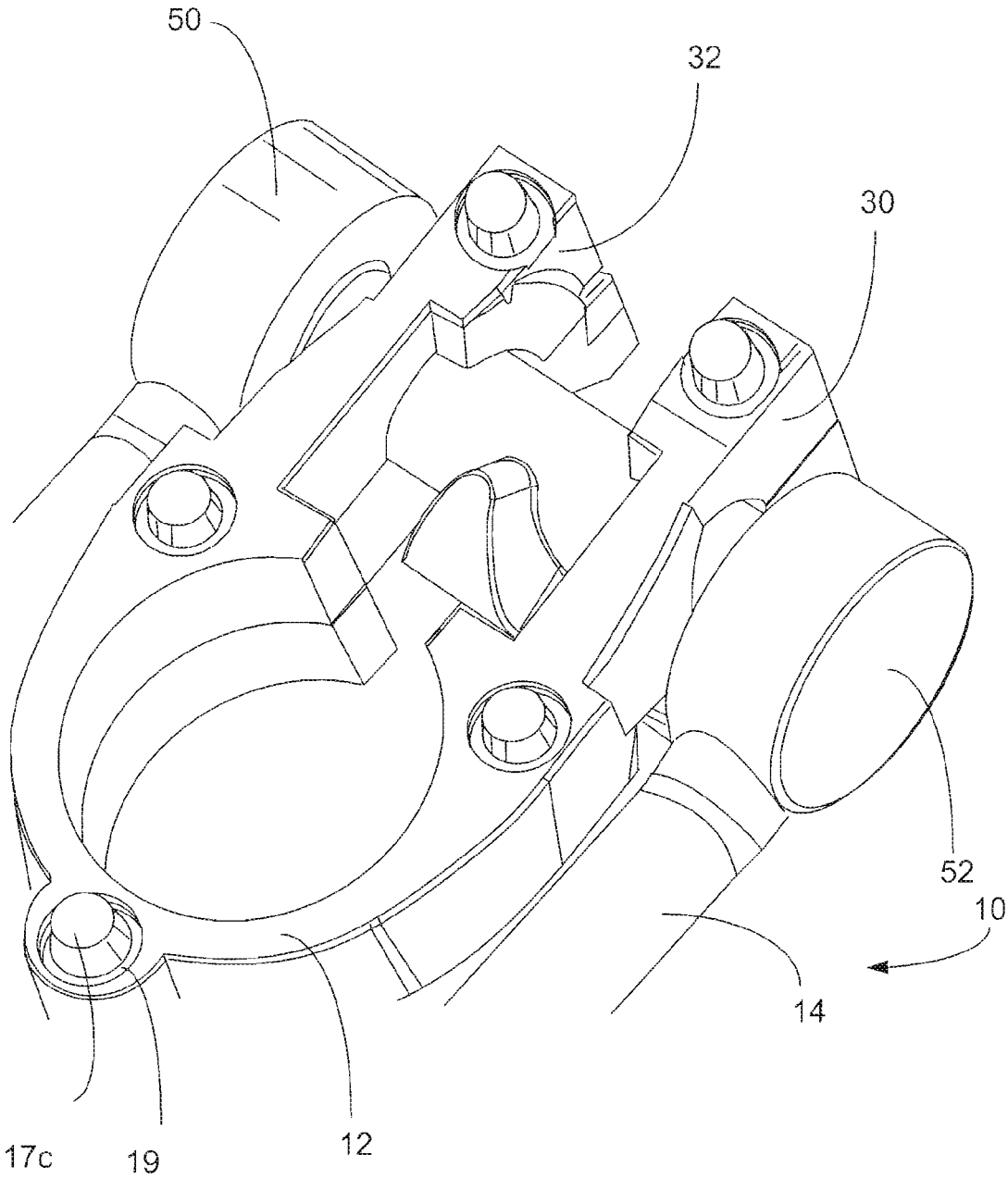
FIGS. 7, 8 and 9 show a further embodiment of the connector of the present invention maintaining the connector in the clamped condition.
Figure 8:
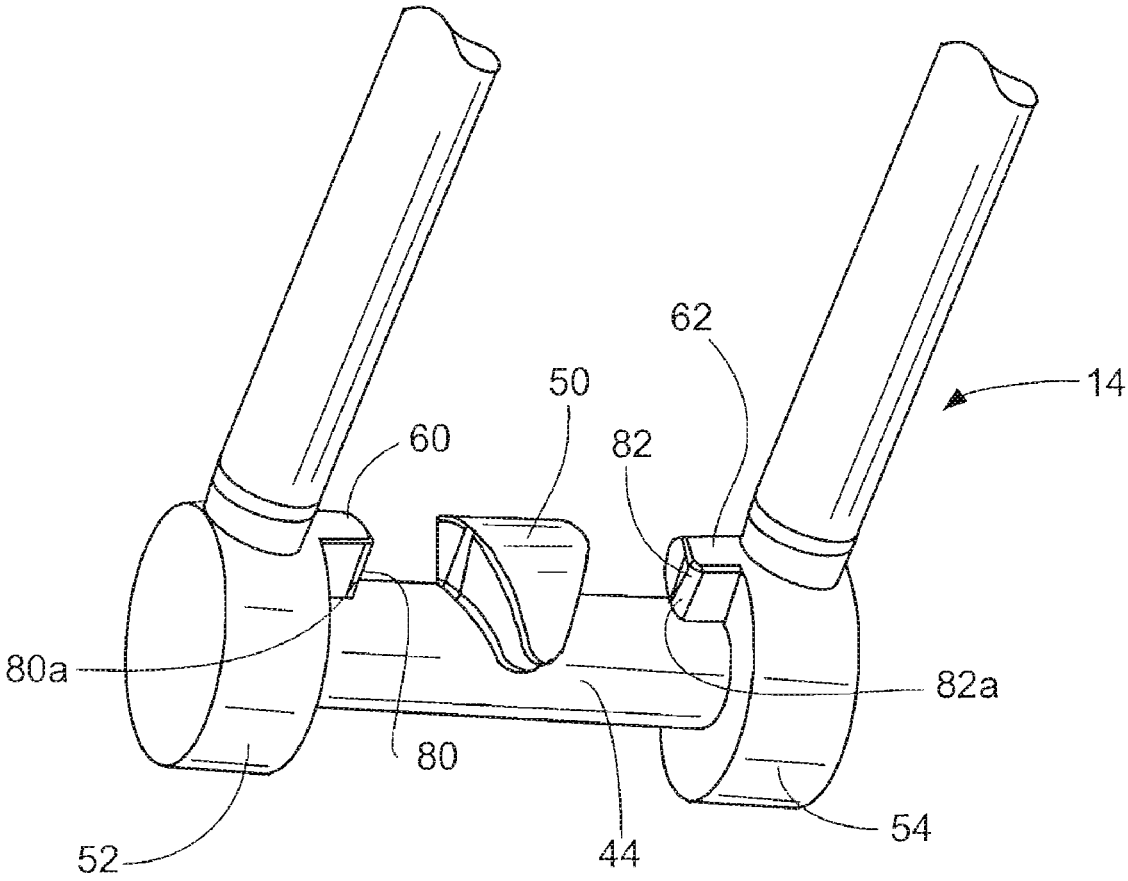
Figure 9:
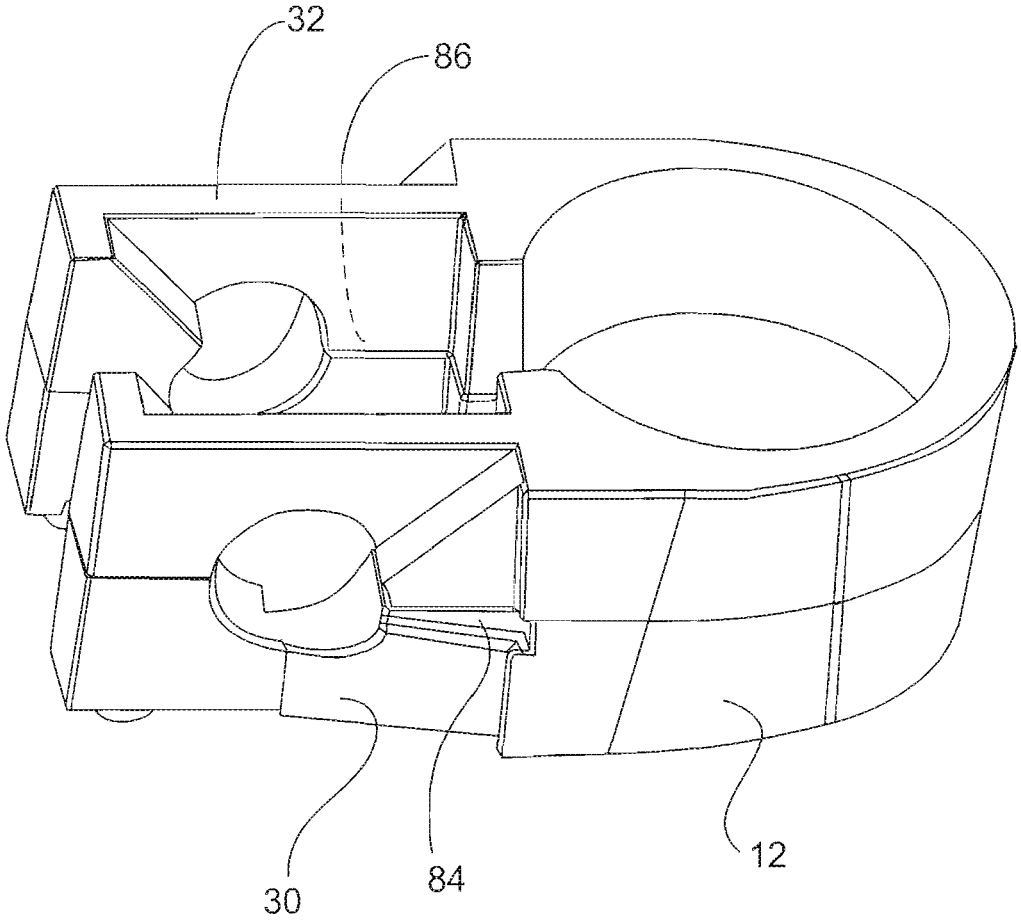

As particularly shown in FIGS. 7, 8 and 9, a further feature of the present invention may be optionally employed. As shown in FIG. 7, the connector 10 is shown in its first or clamped position with the lever 14 rotated downwardly to cause inward movement of clamping arms 30, 32 so that the body 12 is clamped around the battery post. In this condition, the present invention also provides a locking means for maintaining the lever 14 in the first or clamped position for preventing inadvertent movement of the lever 14 and unclamping of the connector due to forces such as vibratory forces or other inadvertent contact during use.

As shown in FIG. 8, the cams 60, 62 extending from flanges 52, 54 may each include an extending rib 80, 82 which extend inwardly therefrom. The ribs 80, 82 may include a curved or chamfered surface 80*a*, 82*a*, respectively. The ribs 80, 82 are designed for accommodation within grooves 84, 86 in connector body 12, as shown in FIG. 9. The grooves 84, 86 are positioned on opposed side surfaces of arms 30, 32 and are outwardly directed therefrom.

The grooves 84, 86 captively accommodate ribs 80, 82, respectively, so that upon movement of the lever 14 to its first or clamped position, as shown in FIG. 7, the ribs 80, 82 become resident within the grooves 84, 86. The rounded or chamfered surfaces 80*a*, 82*a* of ribs 80, 82 facilitate insertion of the ribs into the grooves 84, 86. It is contemplated that slight inward movement of the clamping arms 30, 32 allows the ribs 80, 82 to become captive in grooves 84, 86. The captive retention of the ribs 80, 82 within the grooves 84, 86 is such that, forces which may tend to act upon the lever 14, such as vibratory forces or inadvertent contact, will not dislodge the lever 14 from the clamped position. The rounded edges 80*a*, 82*a* of ribs 80, 82 not only permits insertion of the ribs 80, 82 into the grooves 84, 86, they also allow such retention to be overcome so that the lever 14 may be intentionally moved from the clamped condition to the unclamped condition when it is desired to remove the connector 10 from the battery post. It is also contemplated that slight inward movement of arms 30, 32 allow the ribs 80, 82 to be removed from grooves 84, 86.

Figure 6:
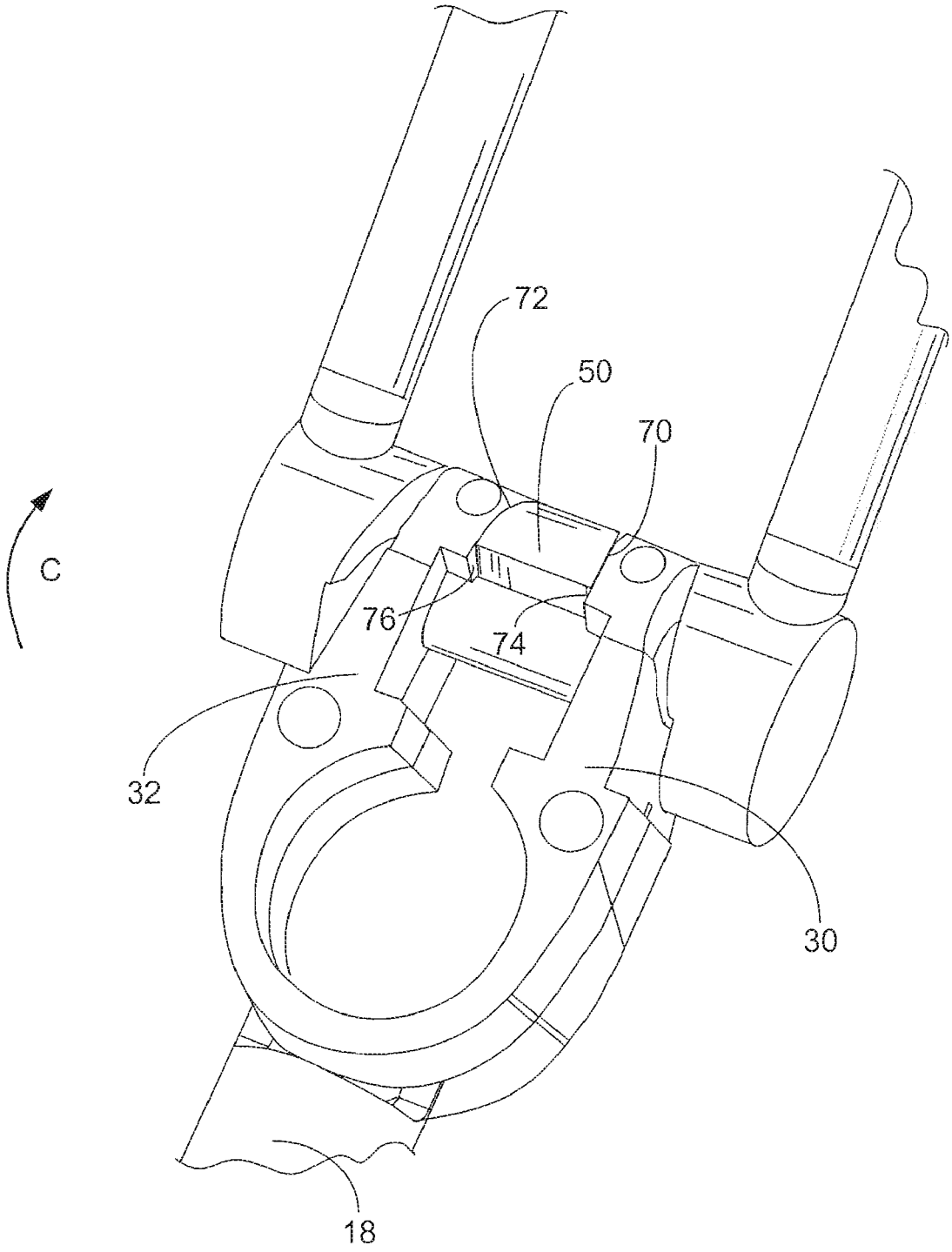

Referring again to FIGS. 2 and 6, movement of the lever 14 to spread apart or unclamp the connector body 12 from post 25 is shown. Lever 14 is rotated in the removal direction of arrow C (opposite the direction of arrow A). As the pivot pin 44 is rotated, the cam surfaces 70, 72 of central member 50 (also shown in FIG. 5) engage the cam surfaces 74, 76 of arms 30, 32. As the cam surfaces 74, 76 progressively engage the wedge-shaped central member 50 by continued rotation of lever 14, the arms 30, 32 spread apart in the direction of arrow D of FIG. 2. This opens the connector body 12 permitting the connector body 12 to be removed from the terminal post 25.

The present invention thus allows for the clamping and unclamping of the connector body to the terminal post without need for separate fastening members to hold the connector body onto the terminal post. Moreover, it permits removal of the clamping body from the terminal post without need of a tool.

As the connector of the present invention is designed to preferably terminate a battery cable to a terminal post of a battery, two connectors are commonly employed with a single battery. Often, the positive terminal has a different diameter from the negative battery terminal. It is contemplated that two different size connectors may be manufactured. One would be for the positive terminal which has a first size and the other would be for the negative terminal which has a second size different from the first size. In these instances, the connector of the present invention may also be color coded to indicate which size and which terminal is to be used with each connector.

Various changes to the foregoing described and shown structures would now be evident to those skilled in the art. Accordingly, the particularly disclosed scope of the invention is set forth in the following claims.

What is claimed is:

1. A cable connector comprising:

a body having a termination end for terminating an electrical cable and a clamping end for clamping to a terminal post;

said clamping end including a pair of spaced apart deformably movable clamping arms for supporting said terminal post therebetween; and a lever including a pivot pin extending between said clamping arms and an elongate handle extending therefrom, said lever being rotatably attached to said arms, said lever being engageable with said arms on opposed outside and inside surfaces thereof, said lever being rotationally actuatable between a first position urging said arms towards one another by said engagement with said outside surfaces to clamp said clamping end to said terminal post and a second position urging said arms apart by said engagement with said inside surfaces so as to unclamp said arms from said terminal post to permit removal of said connector body from said terminal post;

wherein said arms and said lever include cooperative first cam members, for engagement upon movement of said lever to said first position, and cooperative second cam members for engagement upon movement of said lever to said second position;

said cooperative first cam member including said outside surfaces of said clamping arms having outwardly facing first cam arm surfaces; and said pivot pin including inwardly facing first cam pin surfaces for engagement with said first cam arm surfaces;

said cooperative second cam member including said inside surfaces of said clamping arms having inwardly facing second cam arm surfaces and said pivot pin including outwardly facing second cam pin surfaces for engaging with said cam arm surfaces;

said pivot pin including a central member positioned between said clamping arms and wherein said outwardly facing second cam pin surfaces are formed on said central member.

2. A cable connector of claim 1 wherein said termination end of said body includes a barrel portion extending therefrom for accommodating said electrical cable.

3. A cable connector of claim 1 further including cooperative locking means for captively retaining said lever to said body in said first position.

4. A cable connector of claim 3 wherein said locking means includes:

a pair of inwardly facing ribs on said lever; and a pair of outwardly facing grooves on said clamping arms; said ribs being captively resident within said grooves upon movement of said lever to said first position.

5. A cable connector of claim 1 wherein said body includes an upper body portion and a lower body portion coupled thereto and wherein said lever is rotatably coupled between said upper and lower body portions.

6. A cable connector of claim 1 wherein said central member includes a wedge shaped member protruding from said pivot pin, wherein tapered sides of said wedge shaped member form said second cam pin surfaces.

* * * * *